United States Patent [19]

Harrison, Jr.

[11] 4,250,668

[45] Feb. 17, 1981

[54] CEILING STRUCTURE

[76] Inventor: John E. Harrison, Jr., 1300 Parkins Mill Rd., Greenville, S.C. 29607

[21] Appl. No.: 77,326

[22] Filed: Sep. 20, 1979

[51] Int. Cl.[3] ..... G09F 7/18

[52] U.S. Cl. ..... 52/39

[58] Field of Search ..... 52/39, 648, 63

[56] References Cited

U.S. PATENT DOCUMENTS

| | | | |
|---|---|---|---|
| 2,527,031 | 10/1950 | Rambusch | 52/63 X |
| 3,791,089 | 2/1974 | Alderman | 52/63 X |

FOREIGN PATENT DOCUMENTS

| | | | |
|---|---|---|---|
| 2376929 | 8/1978 | France | 52/63 |
| 2405339 | 5/1979 | France | 52/39 |

*Primary Examiner*—Carl D. Friedman

*Attorney, Agent, or Firm*—Bailey, Dority & Flint

[57] ABSTRACT

A grid structure is illustrated for positioning in interwoven relation therewith a length of fabric in open width constituting an assembly useful as a ceiling and the like inside buildings.

5 Claims, 6 Drawing Figures

CEILING STRUCTURE

BACKGROUND OF THE INVENTION

Ceiling structures of the prior art are generally permanent in nature and are not readily changeable to vary or create desirable decorative effects. The prior art includes patio awning structures which are downwardly inclined to permit rain water to run off. The present invention contemplates the use of a grid carrying interwoven fabric in open width as an inside ceiling structure and the like in buildings. Exemplary of the Prior art are U.S. Letters Pat. Nos. 1,092,217; 2,415,202; 3,063,519; 3,181,542; 3,288,158 and 3,807,421.

SUMMARY OF THE INVENTION

A grid structure for use in positioning a length of decorative fabric in open width as a ceiling inside buildings is illustrated as including a three-dimensional grid formed of tubular members. The grid includes longitudinally spaced transverse bars in substantially horizontal alignment. The bars are alternately positioned in vertically spaced planes. Truss means connect the bars forming the grid and the grid is so disposable in elevated position receiving at least one length of cloth fastened upon the bars in woven or alternating over and under relation to adjacent bars. Thus, the appearance of the ceiling may be varied by changing the fabric or its position on the grid.

Accordingly, a ceiling system grid through which fabric or other similar materials are woven is comprised of interconnecting members, forming a structure suitable for carrying open widths of fabric in an interwoven effect. The grid may be constructed of any of various rigid materials; metallic tubing, plastic tubing, wooden dowels, and the like. The fabric to be woven into the ceiling may be any or a combination of various suitable materials; textile fabrics, plastics, vinyls, metallic screening, and the like. The ceiling system is intended to enhance or improve the environment in which it is used and is readily changeable in appearance by changing the decorative fabric to exhibit any decorative appearance.

Although the use of such ceilings may be justified solely for achieving a desired decorative effect, this ceiling system with appropriate selection of fabrics or other materials to be woven may also utilize materials of a non-decorative nature to achieve other advantages. A ceiling system hereof, unlike most conventional ceilings, is equally visually acceptable from all points of observation. Most ceilings are intended to be seen from a point below the ceiling level and thereby their applications are limited. An example of a situation in which a ceiling constructed in accordance with the present invention are especially useful include some hotels built with a large central atrium. Within this space it may be desired to define a subspace of specific use as a restaurant. One way of defining such an area would be by providing a ceiling unique to that area. Such a ceiling would be viewed not only from below but also from many points above as well as from the side.

Ceiling systems in accordance herewith inherently possess structural integrity beyond that of most ceiling systems. The frame of such a system must necessarily have a certain strength/rigidity ratio to suitably accept the fabric woven. The fabric, having been woven, does not diminish the system's strength. This characteristic structural integrity allows that ceiling systems hereof to be suspended from or supported at, a minimum number of points. This facilitates the installation as well as making possible installations in spaces that would not otherwise be practical.

Ceilings hereof because of inherent rigidity may be repositioned within a space with relative ease and further will work well in conjunction with various existing equipment that could facilitate its repositioning. For example, consider a space that is used not only as an exhibition hall but also for various social functions. While it is probably desirable to have a maximum ceiling height in an exhibition hall, a lower ceiling would seem more appropriate when that space is used for functions more social in nature. A lower ceiling tends to create a more informal environment suitable to more social uses as parties or conventions. One of the ways by which such ceiling systems may be located is by suspension with cables attached to overhead building structure. If the cables were run through pulleys attached to the structure, and possibly by way of other pulleys functioning as guides, these cables eventually being fastened to a winch-type device, then it would be possible with such an arrangement, to alter the height of the ceiling easily.

There are, of course, other ways by which such a ceiling system might be positioned; i.e., a cable pulley winch arrangement similar to the one previously described might be used to cant the ceiling so that it is no longer parallel with the floor. For further example, a ceiling system hereof could be attached to an overhead horizontal track such that it could be moved to a different location within a greater space. The ability to raise and lower the ceiling also facilitates changing reweaving of the fabrics, as the frame may be lowered to a convenient working level. Therefore, it is practical to change or reweave fabrics frequently or seasonally to vary decorative effects or to remove fabric for cleaning. Such a ceiling system may be woven with any of a variety of suitable materials. Use of certain material, may impart desirable contrasting characteristics upon this system. For example, a translucent fabric may be useful in creating lighting effects. Further, it would be possible to install a ceiling system woven with a translucent fabric beneath existing lighting without necessarily altering that lighting. A semi-transparent fabric or screening would be useful in an area where a ceiling is needed yet it is desired that the area above the ceiling remain in view. From the earlier example of a ceiling above a restaurant in a hotel atrium it should be observed that while it is desirable to have a ceiling that defines the specific area of the restaurant, it may not be desirable to totally visually isolate this area from the larger area.

A transparent material would be useful where a ceiling functions as a physical but not visual barrier. Sun screening or reflective materials could be used effectively beneath a skylight to control or moderate the amount of incoming light or solar energy. Heat absorbing fabrics might be used beneath a skylight. Beneficial accoustical properties could be achieved by weaving appropriate sound absorbing materials.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
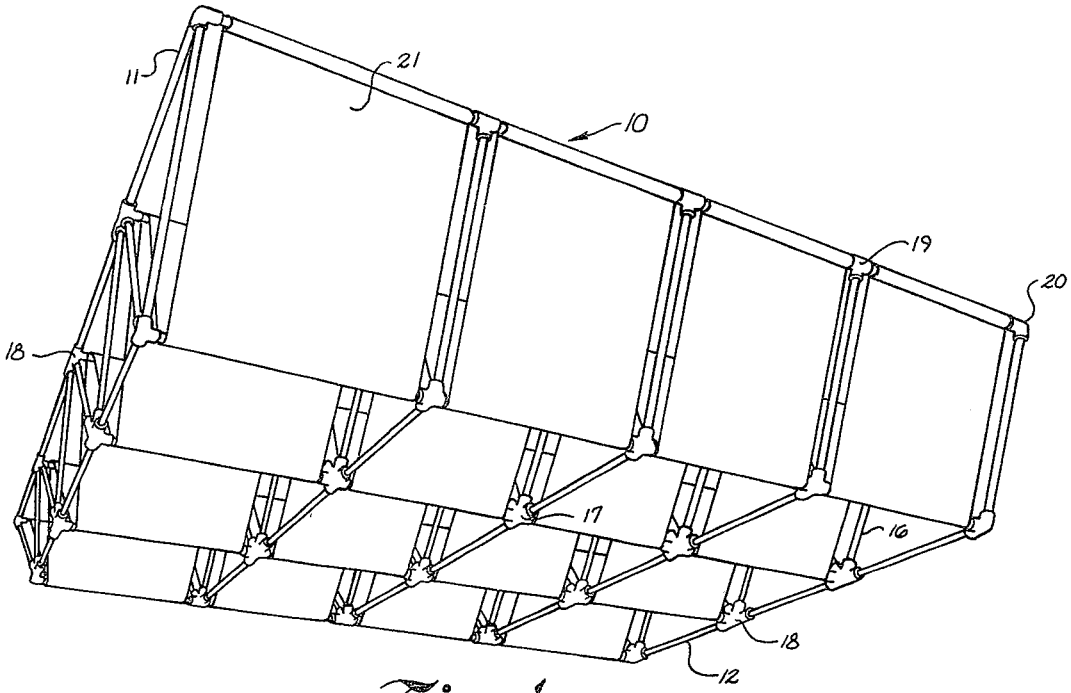
FIG. 1 is a perspective view of a complete ceiling looking from beneath such structure.
Figure 2:
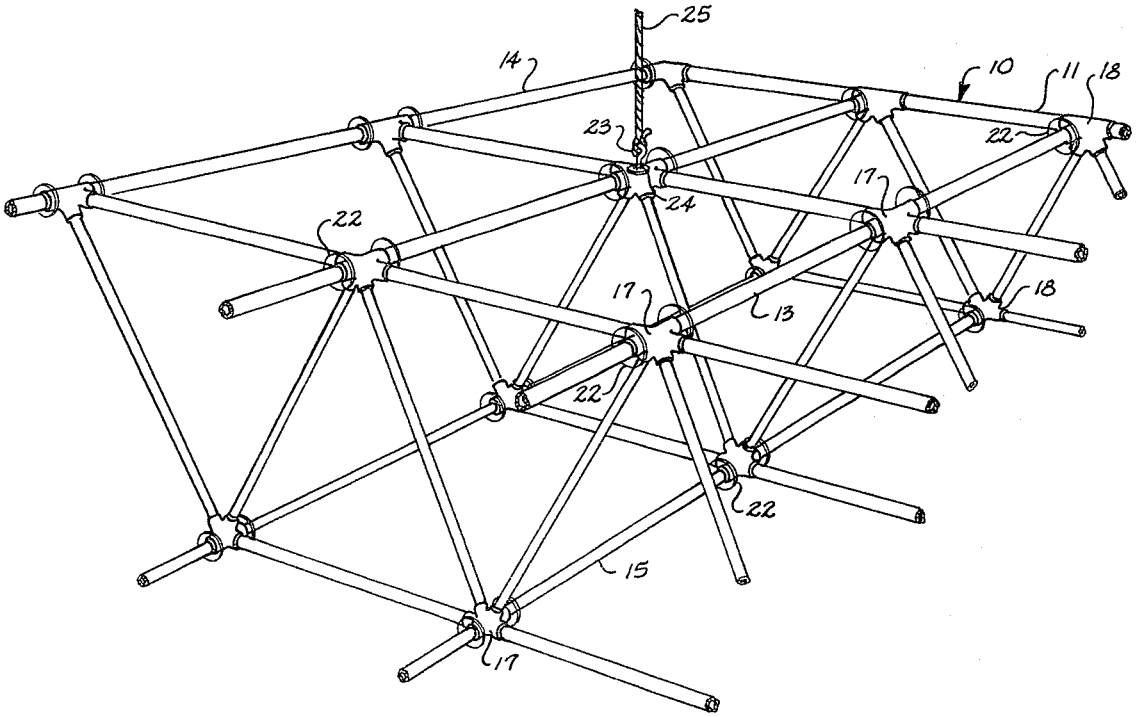
FIG. 2 is an enlarged perspective view of a grid strucure constructed in accordance with the invention with fabric omitted.
Figure 6:
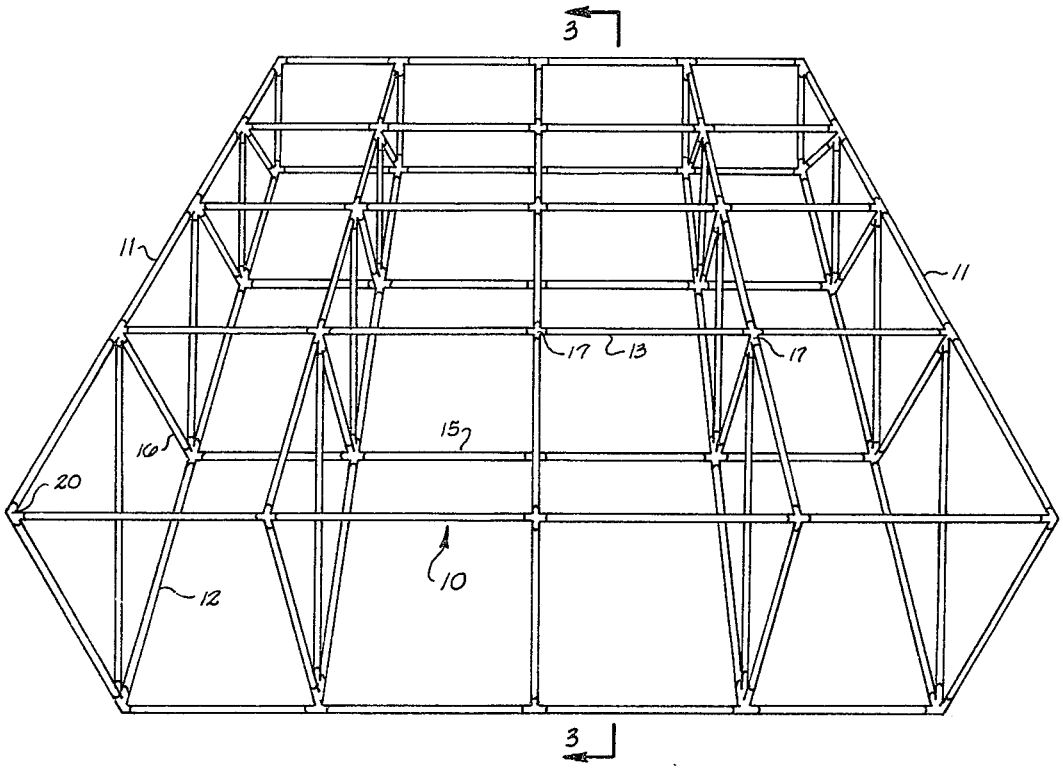
FIG. 6 is a front perspective view of a grid constructed in accordance with the invention.
Figure 3:
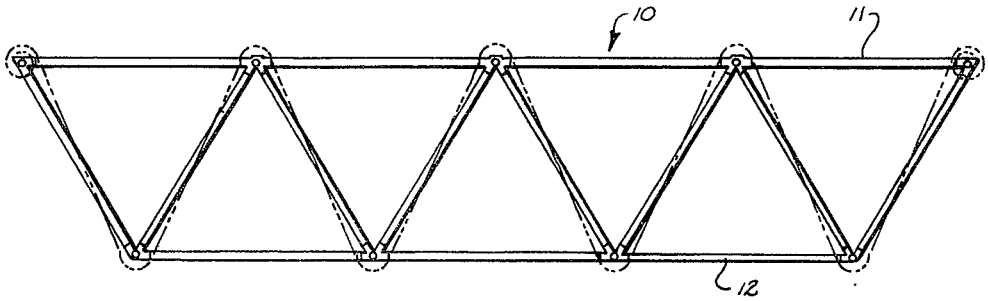
FIG. 3 is a side elevation illustrating fabric woven and attached to the grid frame.
Figure 4:
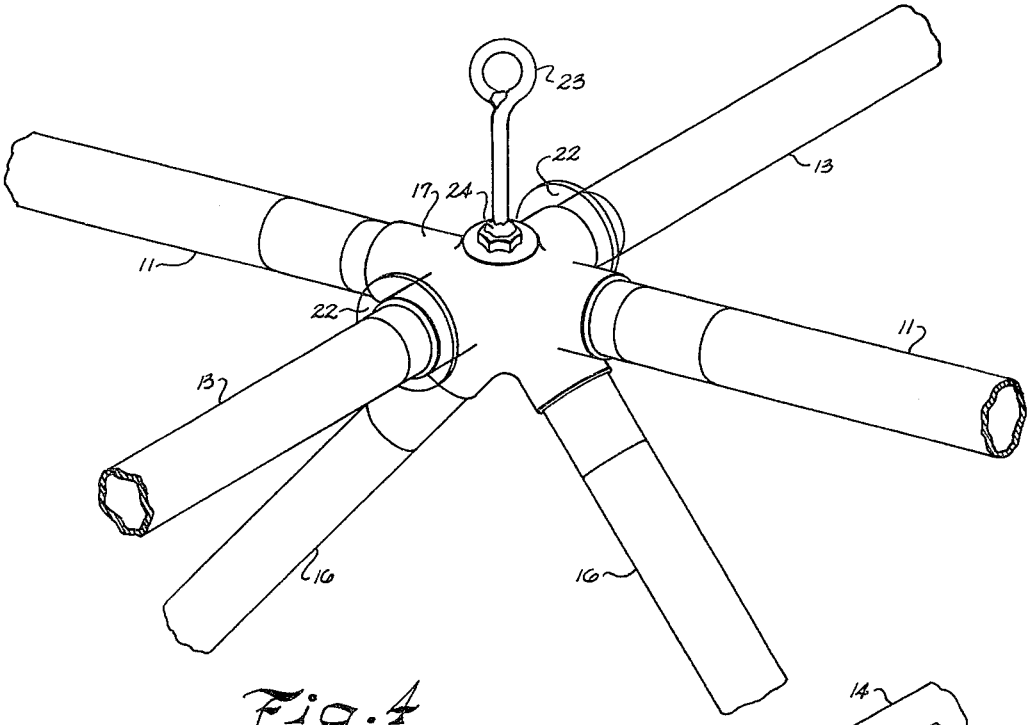
FIG. 4 is a perspective view illustrating a coupling with cable attachment provision, fabric location means and tubing attachment.

The drawings illustrate a frame or grid structure which is broadly designated at 10. Upper longitudinal tubular frame members are illustrated at 11. A lower longitudinal tubular member is illustrated at 12. The reference numeral 13 designates an upper transverse tubular frame member or bar.

The numeral 14 designates an end transverse frame member or bar while lower transverse tubular frame members are designated at 15. The numeral 16 designates intermediate diagonal tubular frame members constituting a part of the truss arrangement described herein. The reference character 17 broadly designates a coupling section, while the numeral 18 designates a modified coupling constructed in accordance with the invention. Such a coupling may be utilized as an end coupling as designated at 19. The numeral 20 designates a modified end coupling.

The length of fabric is designated in the drawings at 21 passing over the bars constituting part of the grid. A transparent plastic washer is illustrated at 22 for guiding the cloth. A suspension eye bolt designated at 23. A nut 24 completes a suspension arrangement for carrying the grid and offering support in the area of the couplings through cables 25. The numeral 26 designates a cotter pin for fastening the tubular bar in the assembly. The numeral 27 designates a tape for attachment of the fabric as described herein to the tubular surface of a transverse bar.

A ceiling unit such as the one shown might best be partially preassembled such that on site installation would require less time and effort. The preassembled components would be of a nature that could be easily packaged for transport. For the unit shown, the transverse frame members would be connected at the installation site. All other frame members would be preassembled forming basically two-dimensional truss-like components that could be stacked for transport.

Though the ceiling unit is illustrated as being suspended by cables, this is only one of many ways by which a unit could be located. A unit could be rigidly attached to the roof structure or adjacent walls, suspended by vertical poles or columns, or other suitable variations thereof. While it is possible to construct structures of great size, it might be more practical, taking into consideration transport and installation realities, to use multiple units to cover large areas. Installation of multiple units would allow for creation of numerous decorative effects. Units might be positioned individually at varying heights in a given space, positioned such that they form an overall pattern not possible with a single unit or suitable variations thereof.

Figure 5:
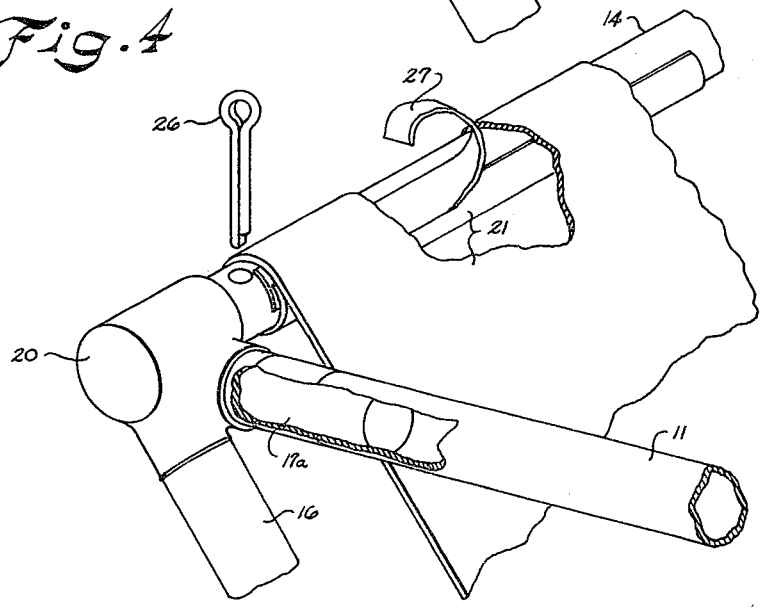
FIG. 5 is a perspective view illustrating a fabric tensioning provision.

The coupling tube assembly shown in FIG. 5, for example, as being swaged with coupling section insert 17*a* within the tubular member is one but not the only way by which tubular members could be assembled forming a suitable frame. Members could be welded or otherwise joined or tubing could be attached to the coupling with adhesives. Tube members might be internally threaded to mate with threaded coupling pegs or the like. It might be desirable to attach the tubing to couplings in a non-permanent manner as to allow the disassembly or reconfiguration of a ceiling unit. Tubing could be fastened to the coupling with bolts or other appropriate fastenings. In the example illustrated, the fabric was attached to the frame with double surfaced tape. There are other ways by which it might be attached such as with Velcro material. One or both ends of the fabric could be sewn in a manner to provide a pocket to contain an end transverse tube and in this case the fabric would have to be installed within the frame at an earlier stage of the assembly than normally required. Grommets could be applied to the ends of fabric lengths allowing the fabric to be laced onto the frame.

As some fabrics expand or contract due to changes in the temperature or humidity, an automatic tensioning device might be desirable to maintain a uniform tension on the fabric. One way this could be achieved is with a spring-biased device affixed to the end transverse tube members such that it caused the tubes to rotate in a manner as to take up slack if the fabric's length increased, or correspondingly allow rotation in the opposite direction to prevent an increase of tension if the fabric contracted.

The fabric in a ceiling structure might be movable. Consider a unit with a provision for rotating in either direction the end tubes to which the lengths of fabric are attached and that this could be motorized or operated manually. If a surplus of fabric were wound on the tubes at one end of the frame equal to the amount of fabric exposed, then by shifting the surplus of fabric to the opposite end of the frame by rotating the end tubes in appropriate directions, the fabric visable could be completely altered. This would allow for changing the color of characteristics of a ceiling unit repeatedly without removing the fabric. A unit woven with continuous loops of fabric and provisions for continuously moving that fabric through the frame of a ceiling unit may achieve a continuously changing character. Though the unit shown in FIG. 1 is of an overall rectangular form other configurations are possible. Units may be constructed in a multilevel configuration. Suitable lighting units might be attached to the frame of a ceiling unit hereof.

While a preferred embodiment of the invention has been described using specific terms, such description is for illustrative purposes only, and it is to be understood that changes and variations may be made without departing from the spirit or scope of the following claims.

What is claimed is:

1. A decorative grid structure for use positioning a length of decorative fabric in open width as a ceiling inside buildings comprising:

a three-dimensional grid;

said grid including longitudinally spaced transverse bars in substantially horizontal alignment;

said bars being alternately positioned in vertically spaced planes;

means connecting said bars forming said grid; and said grid being so disposable in elevated position receiving at least one length of cloth fastened upon said bars in alternating over and under relation to adjacent bars;

whereby an appearance of said ceiling may be changed by changing the fabric.

2. The structure set forth in claim 1 wherein said grid is constructed of tubular members having an arcuate surface for positioning said fabric.

3. The structure set forth in claim 1 including means for attaching said fabric in respect to said transverse bars.

4. The structure set forth in claim 2 including coupling sections receiving a plurality of tubular members for assembly of said grid.

5. The structure set forth in accordance with claim 4 including attachment means carried adjacent said coupling sections for suspending said grid.

* * * * *